United States Patent [19]

Steinke

[11] 4,380,973

[45] Apr. 26, 1983

[54] GLOW PLUG FOR DIESEL ENGINES

[75] Inventor: Leo Steinke, WN-Hegnach, Fed. Rep. of Germany

[73] Assignee: Robert Bosch GmbH, Stuttgart, Fed. Rep. of Germany

[21] Appl. No.: 290,598

[22] Filed: Aug. 6, 1981

[30] Foreign Application Priority Data

Oct. 9, 1980 [DE] Fed. Rep. of Germany ..... 3038124

[51] Int. Cl.[3] ..... F02P 19/00

[52] U.S. Cl. ..... 123/145 A; 219/270

[58] Field of Search ..... 123/145 A; 219/260, 219/270; 361/266

[56] References Cited

U.S. PATENT DOCUMENTS 4,252,091 2/1981 Steinke ..... 123/145 A 4,281,451 8/1981 Mann ..... 123/145 A X

FOREIGN PATENT DOCUMENTS 649914 9/1937 Fed. Rep. of Germany ... 123/145 A

*Primary Examiner*—Tony M. Argenbright

*Attorney, Agent, or Firm*—Frishauf, Holtz, Goodman & Woodward

[57] ABSTRACT

To prevent an increase in diameter or the formation of fissures of resistance wire elements which are placed within a glow sleeve (22) of a glow element (13) during a compaction step in which a pulverized or powder-like heat conductive resistance material (26), for example magnesium oxide, is compacted within the glow element (13) to securely seat the resistance wire (24) therein, the resistance wire (24) is made of a plurality, for example two individual wire elements or strands (24/1, 24/2) twisted together, such that the pitch (27) of the twist is greater than n times the diameter of the number of wire strands twisted together, for example, for two wires, about three times the individual wire element or strand diameter.

3 Claims, 2 Drawing Figures

GLOW PLUG FOR DIESEL ENGINES

The present invention relates to a Diesel engine glow plug, and more particularly to glow plug for Diesel engines for mobile use, for example for automotive installation, in which an electrical resistance heating element is located within a metal housing, embedded in a good heat conductive and electrically insulated compacting mass.

BACKGROUND

Glow plugs, particularly for use with Diesel engines and especially for automotive applications frequently have a spiral resistance heating wire which is embedded in a compacted powdery or pulverized mass, for example magnesium oxide. The resistance heating spiral and the magnesium oxide are retained in a thin-walled, closed, sleeve-like metal tube and then compacted so that the spiral heating resistor is tightly retained within the powdery filler in the tube. It has been found, particularly if the resistance wire is made of a material having low ductility, for example tungsten, that the compacting step, done by circumferential hammering or other machining operations, may interfere with the integrity of the cross section of the resistance element; for example, the resistance element may be internally deformed, causing fissures therein, or localized increases in diameter which, in turn, causes a decrease of the electrical resistance value. Resistance wires presently used for most glow plugs customarily contain drawn wire material which, however, also is subject to damage upon being subjected to the compaction step.

THE INVENTION

It is an object to improve a glow plug of generally known construction such that the internal resistance wire will not be deleteriously affected upon subjecting the enclosing metal sleeve to a compaction step and to compaction forces.

Briefly, the glow plug is essentially of standard construction; in accordance with the invention, the resistance wire is made of a plurality of n twisted wire strands which are so twisted together that the pitch of the twist of any one of the wires is greater than n-times the diameter of any one wire. For example, two wires may be twisted together, and the pitch is then preferably so selected that it is greater than two diameters of any one of the wires, for example 2–3 times the wire diameter.

The so made resistance wire is then formed into a spiral and assembled to a glow plug in customary manner.

The resulting structure has the advantage that the diameter of the wire will not increase when it is compressed or compacted; rather, the two individual strands or elements of the wire can shift or move with respect to each other, compaction resulting essentially only in a shifting of the respective pitch of the wires during the compaction operation. Consequently, increase of the diameter of the resistance wire upon working the outside of the assembled glow plug by compaction of the glow plug tube is effectively avoided, and fissures, and breaks as a consequence of such fissures, do not occur.

DRAWINGS

Figure 1:
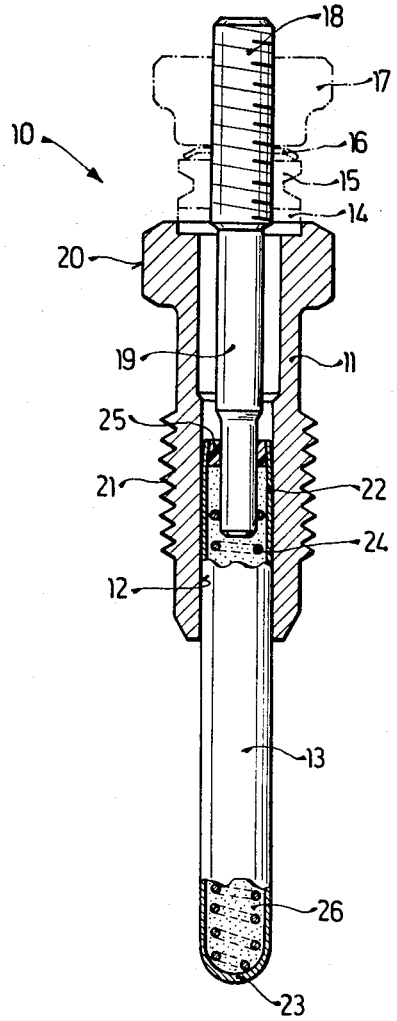
Figure 2:
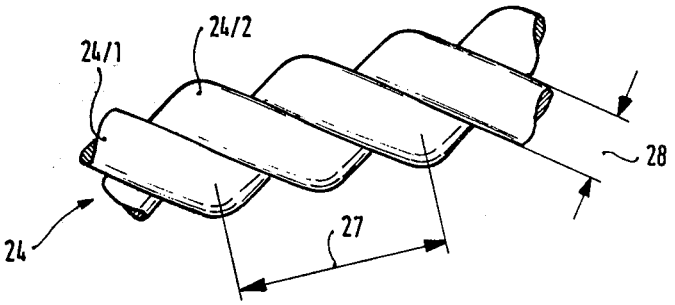

FIG. 1 is a longitudinal part-sectional view through a glow plug of the type to which the present invention relates and illustrating the position of the resistance wire; and FIG. 2 is a greatly enlarged perspective view of the resistance wire.

The general construction of the glow plug is similar to that described, for example, in German Patent Publication Document DE-OS No. 26 37 435. The glow plug 10 has a metal housing 11 with a longitudinal bore 12 formed therein. A glow element 13 of about 6 mm diameter is secured in the housing 11, gas-tight with respect thereto. The connection end of the glow plug is shown in chain-dotted configuration since it is standard and does not form part of the present invention; it includes an insulating ring or washer 14, a terminal nut 15, a compression disk 16 and a connection nut 17, all threaded on a thread 18 of a connecting bolt 19. The connecting bolt 19 is carried through the housing 11, insulated with respect thereto, and extends out of the bore 12 at the terminal end. The housing 11 is formed at the outside in hexagonal form to receive a wrench or socket, similar to a spark plug, and with an external thread 21, to thread the glow plug into the block of an internal combustion engine of the Diesel type.

The glow element 13 is made of a corrosion-resistant tube 22, having a wall thickness of about 0.7 mm, for example stainless steel or the like; at the combustion chamber terminal, the tube is welded shut to form a bottom region 23. One end of a resistance wire spiral 24 is welded into the bottom 23 of the tube 22. The resistance wire spiral 24 is placed axially within the tube 24 and is made, for example, of a customary resistance heat alloy material, such as for example CrAl 20/2; it may, however, also be made of a high-melting metal, such as molybdenum, niobium, tantalum or tungsten. The other end terminal of the resistance wire spiral 24 is welded to the resistance connection of the bolt 19 extending into the upper end portion of the tube 22.

The upper end portion of the tube 22 is closed off by a closing or sealing element 25, for example an insulating washer. The remaining space within the sleeve or tube 22 is filled with a packing 26 made of an electrically insulating and good heat conductive material, for example magnesium oxide. This filler, pulverized or in powder form, is tightly retained within the sleeve 22. It transfers heat from the resistance wire 24 to the glow element 22 and additionally provides for insulation between the respective windings of the resistance wire spiral 24, and between the resistance wire spiral 24 and the tube 22 itself. To increase heat transfer and to retain the wire 24 in predetermined position regardless of shock, vibration and the like, the packing 26 of the glow element 13 is worked by reducing the diameter of the glow element 13, for example by circumferential round hammering or the like. This compacts the packing 26 in the tube 22 and unambiguously and reliably places the resistance wire 24 within the tube 22, secure against movement even under extremes of vibration or shock. Usually, the hammering is done on the glow element 13, after assembly of the spiral resistance wire 24, the connecting bolt 19, and the packing 26, and sealing by the end element 25.

In accordance with the invention, and in order to avoid decrease of the electrical resistance of the resistance wire due to increase of its diameter in hammering, or damage to the resistance wire consequent to the formation of fissures, the wire 24 is made of two twisted strands 24/1, 24/2, as best seen in FIG. 2. The pitch 27 of the wire 24/1 or of the wire 24/2, respectively, is so selected that it is greater than two diameters 28 of any one of the wires. Due to this construction of the wire 24 itself, the pitch 27 only will change when the glow plug 13 is hammered; the diameters 28 of the individual wires 24/1 and 24/2 effectively do not change, and any increase in diameter and deformation of the wires themselves is effectively avoided, so that the cause for fissures and thus breakage of the wires 24 is prevented.

It is not necessary that two wires 24/1, 24/2 be used; a larger number of wires can be twisted together, then requiring, however, a change in the pitch 27 of the respective wires. When using n wires, each having the diameter of the dimension 28, the pitch 27 then must be greater than n-times the diameter 28. In the embodiment shown, the pitch 27 is just under three times the diameter 28 of any one of the wires, which is suitable for most customary glow plug resistance materials. For two wires, a range of pitch of about 2–5 times the wire diameter is suitable, although this range is not critical. In general, a pitch of about 1.5 to 2.5 times the diameter of all the wires together (i.e. n x diameter of any one wire) is suitable.

The invention is particularly applicable when using resistance wires 24 made of a material which is brittle, and has only low ductility, for example tungsten.

Various changes and modifications may be made; for example, the glow plug 10 can be of the type described, for direct introduction into the combustion zone of the combustion chamber of internal combustion engines; the glow plug may, however, be constructed differently, and for example may be of the flaming glow plug type which, in addition to providing for preheating, has a fuel supply line, positioned in the air intake line of an internal combustion engine.

I claim:

1. Glow plug for an internal combustion engine having a housing (11);

a glow element (13) seated within the housing;

a connecting bolt (19) retained within the housing and insulated therefrom, extending into the glow element (13), said glow element (13) comprising a metal sleeve (23) closed at the bottom, a resistance wire element (24) positioned within the sleeve and secured to the bottom (23) of the glow element and connected to the connecting bolt at the other end of the glow element, a filler of a good heat conductive insulating material within the sleeve of the glow element retaining the resistance wire in position, and wherein the sleeve is reduced in diameter after assembly of the wire and the filler to compact the filler therein, wherein, in accordance with the invention, the resistance wire (24) comprises n twisted wire elements or stands (24/1, 24/2), the pitch (27) of the twist of the wire, before reduction of diameter of the glow plug element (13), being greater than n-times the diameter (28) of any one of the strands or wire elements (24/1, 24/2).

2. Glow plug according to claim 1, wherein two strands (24/1, 24/1) are twisted together, and the pitch (27) of the twist is about three times the diameter of any one of the strands or wire elements (24/1, 24/2).

3. Glow plug according to claim 1, wherein the pitch (27) of the twist of the wire elements is between about 1.5–2.5 times the diameter of all the wire elements or strands twisted together.

* * * * *